US011492813B2

(12) United States Patent
Fearon

(10) Patent No.: US 11,492,813 B2
(45) Date of Patent: Nov. 8, 2022

(54) MODULAR GUARD RAIL FOR CONSTRUCTION SCAFFOLDING

(71) Applicant: Colin Fearon, Woodside, NY (US)

(72) Inventor: Colin Fearon, Woodside, NY (US)

( * ) Notice: Subject to any disclaimer, the term of this patent is extended or adjusted under 35 U.S.C. 154(b) by 283 days.

(21) Appl. No.: 16/660,293

(22) Filed: Oct. 22, 2019

(65) Prior Publication Data

US 2020/0123792 A1 Apr. 23, 2020

Related U.S. Application Data

(60) Provisional application No. 62/749,313, filed on Oct. 23, 2018.

(51) Int. Cl.
*E04G 5/14* (2006.01)
*E04G 1/00* (2006.01)

(52) U.S. Cl.
CPC ..... *E04G 5/14* (2013.01); *E04G 1/00* (2013.01)

(58) Field of Classification Search
CPC ..... E04G 5/14; E04G 5/141; E04G 5/142; E04G 5/144; E04G 5/147; E04G 1/00; E04G 21/3295; E04G 21/3233; E04G 21/3266; E04G 21/3276
See application file for complete search history.

(56) References Cited

U.S. PATENT DOCUMENTS 1,189,884 A 7/1916 Stratinsky
1,710,026 A 4/1929 McCormick
2,125,830 A 8/1938 Uecker et al.
3,223,370 A 12/1965 Pignon
3,270,997 A * 9/1966 Gethmann ..... E04G 1/00 182/113
3,385,400 A 5/1968 Whitsett
3,410,365 A 11/1968 Isbell
3,493,208 A 2/1970 Sato
3,717,220 A 2/1973 Donker et al.
3,726,362 A * 4/1973 Puckett ..... E04G 1/14 182/178.6
3,752,262 A 8/1973 Helms
3,791,486 A 2/1974 Marnoch
4,301,627 A 11/1981 Wilson
4,372,425 A * 2/1983 Murphy ..... E04G 5/061 D8/381
4,452,336 A * 6/1984 Sickler ..... E04G 5/04 248/216.1
4,782,914 A 11/1988 Nail
4,821,844 A * 4/1989 Huffman ..... E04G 5/061 248/235
4,869,343 A 9/1989 Anderson
(Continued)

FOREIGN PATENT DOCUMENTS

EP 0283416 A2 9/1988
FR 2 887 574 A1 12/2006
(Continued)

*Primary Examiner* — Daniel P Cahn
*Assistant Examiner* — Shiref M Mekhaeil
(74) *Attorney, Agent, or Firm* — Collard & Roe, P.C.

(57) ABSTRACT

A modular guard rail for construction scaffolding includes first and second vertical support members and horizontal rails defining a guard rail frame. Support brackets are provided for engaging respective vertical posts of the construction scaffolding and a horizontal supporting strut of the construction scaffolding.

4 Claims, 12 Drawing Sheets

(56) References Cited

U.S. PATENT DOCUMENTS 4,984,654 A 1/1991 Anderson
5,314,167 A * 5/1994 Holloman ..... E04G 21/3233 182/113
5,878,838 A * 3/1999 Lapp ..... E04G 5/06 182/113
5,913,508 A 6/1999 Eades
6,003,631 A * 12/1999 Knauth ..... E04G 3/20 182/150
6,006,862 A 12/1999 Palmer
6,131,698 A * 10/2000 Reyland ..... E04G 1/20 182/136
6,443,262 B1 9/2002 Karanouh
6,554,102 B2 4/2003 Schoerer
6,679,482 B2 * 1/2004 Allenbaugh ..... E04G 21/3242 248/231.71
6,983,824 B1 * 1/2006 Dandurand ..... E04G 1/38 182/150
8,622,172 B2 * 1/2014 Murphy ..... E04G 3/18 182/53
8,752,296 B2 * 6/2014 Samons ..... E04G 5/061 29/897.3
10,018,208 B2 * 7/2018 Hollis ..... E04G 7/28
11,047,141 B2 * 6/2021 Cheddie ..... A62B 35/0037
2003/0047382 A1 * 3/2003 Panacci ..... E04G 5/00 182/178.1
2005/0061582 A1 * 3/2005 Karanouh ..... E04G 5/14 182/113
2006/0237263 A1 * 10/2006 Gaines ..... E04G 21/3219 182/113
2020/0318369 A1 * 10/2020 Baca ..... E04G 7/28

FOREIGN PATENT DOCUMENTS

JP 2002188282 A 7/2002
JP 2003147953 A 5/2003

* cited by examiner

MODULAR GUARD RAIL FOR CONSTRUCTION SCAFFOLDING

CROSS REFERENCE TO RELATED APPLICATIONS

This application claims priority under 35 U.S.C. § 119(e) and the benefit of U.S. Provisional Application No. 62/749,313 filed on Oct. 23, 2018, the disclosure of which is hereby incorporated by reference in its entirety.

BACKGROUND OF THE INVENTION

Field of the Invention

The invention relates to a modular guard rail for construction scaffolding.

The Prior Art

A typical construction scaffolding arrangement includes a framework of vertical posts connected by horizontal members which support the planks or decking upon which a worker stands. The assembly of scaffolding may require a worker to stand on the top level of planks or decking in order to install additional framework. This presents a fall danger and consequently safety regulations have been enacted requiring fall protection for heights above six feet.

Existing fall protection means include retractable ("tie off") systems and guard rails. Retractable systems may be required to have a 5000 pound load capacity and have other deficiencies which may make such systems less preferable. Guard rail systems need only have a 200 pound load capacity.

There exists a need for a modular guard rail for construction scaffolding which is lightweight, yet still capable of supporting the 200 pound load required for a scaffolding guard rail. Moreover, there exists a need for a modular guard rail for construction scaffolding which can be installed comfortably by a single worker from a lower level such that the guard rail is already in place when a worker ascends to the uppermost work deck and wherein the worker installing the guard rail can be safely tied off to existing framework fulfilling safety requirements during this process.

Accordingly, it is one object of the invention to provide a guard rail system that creates a safer environment for the installation of scaffolding, because it is routinely difficult to fulfill safety requirements when assembling scaffolds. A modular guard rail and method for installing a modular guard rail according to aspects to the invention permit workers to comply and adhere to guard rail requirements and can be installed prior to workers ascending to an uppermost plank level as yet devoid of framework.

SUMMARY OF THE INVENTION

The invention relates to a modular guard rail for construction scaffolding. The construction scaffolding has vertical posts and horizontal supporting struts.

A modular guard rail according to an aspect of the invention includes a first vertical support member and a second vertical support member disposed substantially parallel to and spaced apart from the first vertical support member. A plurality of horizontal rails and a plurality of vertical end rails define a guard rail frame disposed on an upper portion of the first vertical support member and the second vertical support member.

An upper horizontal member is disposed on a lower portion of the first vertical support member and the second vertical support member and extends between and substantially perpendicularly to the first vertical support member and the second vertical support member. This upper horizontal member has an upper horizontal member first end extending from and proximate the first vertical support member and an upper horizontal member second end extending from and proximate the second vertical support member.

A lower horizontal member is disposed below, spaced apart from and parallel to the upper horizontal member and extends between and substantially perpendicularly to the first vertical support member and the second vertical support member. This lower horizontal member has a lower horizontal member first end extending from and proximate the first vertical support member and a lower horizontal member second end extending from and proximate the second vertical support member.

A first support bracket is disposed on the upper horizontal member first end, a second support bracket is disposed on the upper horizontal member second end, a third support bracket is disposed on the lower horizontal member first end and a fourth support bracket is disposed on the lower horizontal member second end.

Each of the first support bracket, second support bracket, third support bracket and fourth support include two respective leg portions and a respective connecting portion connecting the two leg portions and defining a respective open mouth portion opposite the connecting portion and between the two leg portions. Each of the respective open mouth portions of the first support bracket, second support bracket, third support bracket and fourth support bracket face a same direction parallel to the upper horizontal member and lower horizontal member.

The first support bracket and third support bracket are configured to engage a first vertical post of the construction scaffolding. The second support bracket and fourth support bracket are configured to engage a second vertical post of the construction scaffolding.

A fifth support bracket is disposed on the lower horizontal member first end and includes two leg portions and a connecting portion connecting the two leg portions and defining an open mouth portion opposite the connecting portion and between the two leg portions. The open mouth portion of the fifth support bracket faces a direction perpendicular to the upper horizontal member and lower horizontal member.

The fifth support bracket is configured to engage a horizontal supporting strut of the construction scaffolding.

In a further aspect of the invention, the second support bracket and fourth support bracket are configured so that the upper horizontal support member and lower horizontal support member rest on a respective upper horizontal support member and a respective lower horizontal support member of a previously installed neighboring modular guard rail.

In a further aspect of the invention, the modular guard rail includes a balancing strut disposed above, spaced apart from and parallel to the upper horizontal member and extending between and substantially perpendicularly to the first vertical support member and the second vertical support member.

In a further aspect of the invention, the plurality of vertical end rails defining the guard rail frame include a first vertical end rail and a second vertical end rail, each of which is located approximately three inches from an edge of an adjacent vertical post of the construction scaffolding.

In a further aspect of the invention, a modular guard rail includes a first vertical support member and a second vertical support member disposed substantially parallel to and spaced apart from the first vertical support member. A plurality of horizontal rails extend between and substantially perpendicularly to the first vertical support member and second vertical support member and along with the first and second vertical support member define a guard rail frame.

A first support bracket is disposed on a first side of the modular guard rail adjacent the first vertical support member, a second support bracket is disposed on a second side of the modular guard rail opposite the first side and adjacent the second vertical support member, a third support bracket is disposed on the first side of the modular guard rail adjacent the first vertical support member, and a fourth support bracket is disposed on the second side of the modular guard rail adjacent the second vertical support member;

Each of the first support bracket, second support bracket, third support bracket and fourth support bracket include two respective leg portions and a respective connecting portion connecting the two leg portions and defining a respective open mouth portion opposite the connecting portion and between the two leg portions.

Each of the respective open mouth portion of the first support bracket, second support bracket, third support bracket and fourth support bracket face a same direction parallel to the plurality of horizontal rails.

The first support bracket and third support bracket are configured to engage a first vertical post of the construction scaffolding and the second support bracket and fourth support bracket are configured to engage a second vertical post of the construction scaffolding.

A fifth support bracket is disposed on the first side adjacent the first vertical support member. The fifth support bracket includes two leg portions and a connecting portion connecting the two leg portions and defining an open mouth portion opposite the connecting portion and between the two leg portions.

The open mouth portion of the fifth support bracket faces a direction perpendicular to the plurality of horizontal rails and the fifth support bracket is configured to engage a horizontal supporting strut of the construction scaffolding.

In a further aspect of the invention, the second support bracket and fourth support bracket are configured so that the second support bracket rests on a respective first support bracket of a previously installed neighboring modular guard rail and the fourth support bracket rests on a respective third support bracket of a previously installed neighboring modular guard rail.

In a further aspect of the invention, the first vertical support member and second vertical support member are located approximately three inches from an edge of an adjacent vertical post of the construction scaffolding.

In a further aspect of the invention, a method for installing a modular guard rail on a construction scaffolding includes the steps of providing a modular guard rail as set forth above, manually moving the modular guard rail in a lateral direction such that the first support bracket and third support bracket engage a first vertical post of the construction scaffolding and the second support bracket and fourth support bracket engage a second vertical post of the construction scaffolding and manually moving the modular guard rail in a downward direction such that the fifth support bracket engages a horizontal supporting strut of the construction scaffolding.

An advantage of a modular guard rail for construction scaffolding and a method for installing same according to embodiments of the invention is that the design includes no moving parts and requires no nuts, bolts or removable fasteners to secure the modular guard rail to the construction scaffolding. Rather, the guard rail is secured to the construction scaffolding by support brackets attached to both sides of a scaffolding framework bay. The support brackets are securely engaged with the scaffold frame and supporting struts by lateral and downward movement. Additionally, the support brackets capture the frame and support strut in a manner such to prevent both lateral and perpendicular movement of the guard rail and providing strength to resist a load of 200 pounds.

Further advantages of a modular guard rail for construction scaffolding and a method for installing same according to embodiments of the invention are that the modular guard rail can be installed comfortably by a single worker from a lower level such that the guard rail is already in place when a worker ascends to the uppermost work deck and that the worker installing the guard rail can be safely tied off to existing framework fulfilling safety requirements during this process.

The inventive guard rail is lightweight yet still capable of supporting the 200 pound load required for a scaffolding guard rail. For example, the guard rail frame members may be made from tubular steel, aluminum, or any other suitable material and the support brackets may be made from steel "u" channel or any other suitable material.

BRIEF DESCRIPTION OF THE DRAWINGS

Other benefits and features of the present invention will become apparent from the following detailed description considered in connection with the accompanying drawings. It is to be understood, however, that the drawings are intended as an illustration only and not as a definition of the limits of the invention.

In the drawings, wherein similar reference characters denote similar elements throughout the several views.

DETAILED DESCRIPTION OF THE DRAWINGS

Figure 1A:
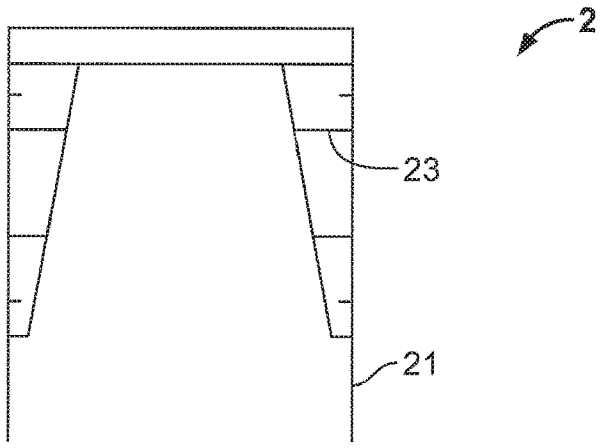
FIG. 1*a* shows a side view of a construction scaffolding.
Figure 1B:
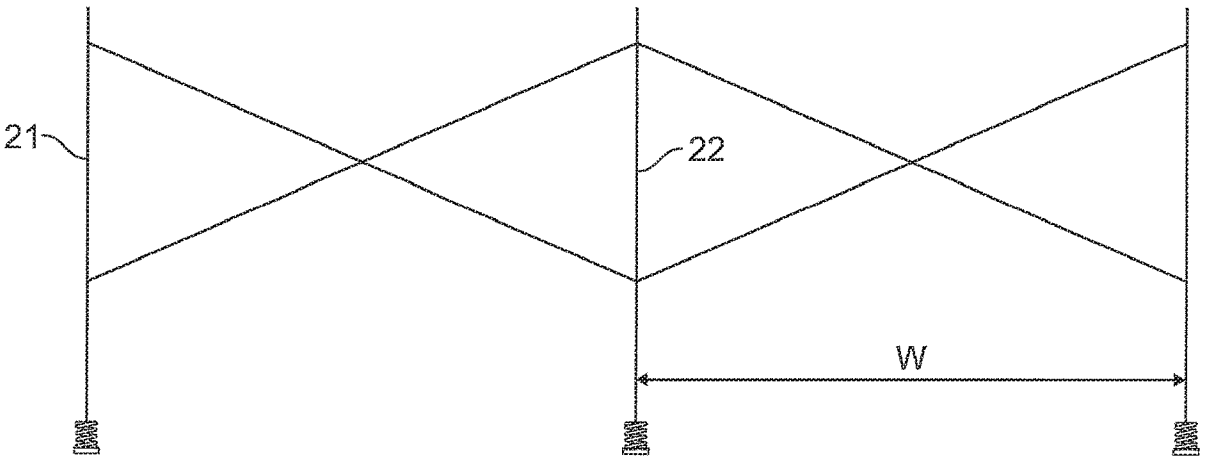
FIG. 1*b* shows a front view of the construction scaffolding shown in FIG. 1*a;*

Referring now in detail to the drawings and, in particular, FIG. 1*a* is a schematic side view and FIG. 1*b* is a schematic front view of a construction scaffolding 2 to which a modular guard rail according to embodiments of the invention can be secured. As shown, the scaffolding structure includes a plurality of vertical posts 21, 22 and a plurality of horizontal supporting struts 23. The vertical posts 21, 22 and/or horizontal supporting struts 23 may be modular pipe frames or any other structure suitable for supporting workers and equipment on the scaffolding frame. The scaffolding frame may be kept plumb and stabilized by one or more cross members which will vary in dimension and grade depending on the required width (W) of the scaffolding bay. Leveling jacks may be employed in connection with the vertical posts 21, 22 for leveling the scaffolding structure.

Figure 2:
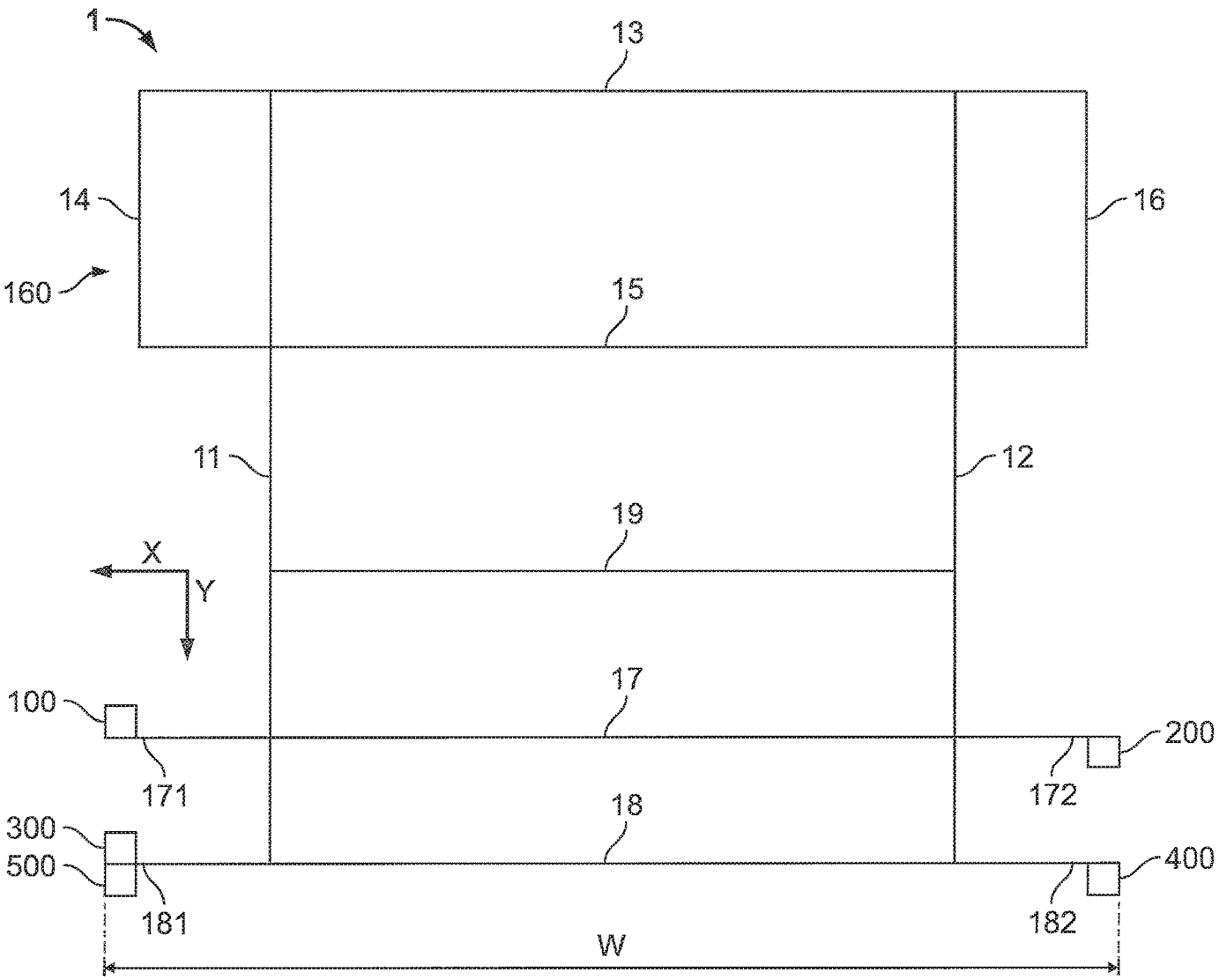
FIG. 2 shows a modular guard rail according to an embodiment of the invention.

FIG. 2 shows a modular guard rail 1 according to an embodiment of the invention. The modular guard rail 1 can be temporarily positioned on an associated construction scaffolding 2 and includes vertical members 11, 12 and horizontal members 17, 18 defining a guard rail frame structure 160 that engages with existing scaffold units in series to provide a guard rail system on both sides of a scaffold while in the process of assembly.

The modular guard rail 1 has no moving parts and is secured via support brackets 100, 200, 300, 400, 500 attached to both sides of the framework bay. The support brackets do not require moving parts or removable fasteners and are attached to the scaffold vertical posts and horizontal supporting struts by lateral and downward movement. The support brackets capture the scaffold vertical posts 21, 22 and support strut 23 in a manner such to prevent both lateral and perpendicular movement and can provide strength to a degree of 200 pounds to the guard rail.

The modular guard rail 1 is designed to be installed comfortably by a single worker who can be safely tied off to existing framework fulfilling safety requirements during this process. The modular guard rail 1 can be temporarily installed, removed and transferred for use as a fall risk eliminating guard rail incorporated into the procedure of scaffold structure assembly.

As shown, the modular guard rail 1 includes a first vertical support member 11 and a second vertical support member 12 disposed substantially parallel to and spaced apart from the first vertical support member 11. The vertical support members 11, 12 are positioned at locations defined by the width of the scaffolding bay into which they are to be installed. These vertical support members 11, 12 perpendicularly support a lattice of horizontal members 13, 15, 17, 18 creating a section of perimeter railing on top by members 13, 15 and structure 17, 18 for coupling support brackets 100, 200, 300, 400 500.

In particular, a plurality of horizontal rails 13, 15 and a plurality of vertical end rails 14, 16 define a guard rail frame 160 disposed on an upper portion of the first vertical support member 11 and the second vertical support member 12. Vertical end rails 14, 16 define the boundaries of the guard rail frame 160. The vertical end rails may be located approximately three inches past the plumb edge location of the next installed vertical post, such as a modular pipe frame, when the modular guard rail 1 is in an installed condition. This design will provide approximately six inches of space between each railing at the upper level to enable the installation of tie pipes to the structure that the construction scaffolding is serving without impeding the procedural movement of the transfer of a guard rail to the next location.

An upper horizontal member 17 is disposed on a lower portion of the first vertical support member 11 and the second vertical support member 12 and extends between and substantially perpendicularly to the first vertical support member 11 and the second vertical support member 12. This upper horizontal member 17 has an upper horizontal member first end 171 extending from and proximate the first vertical support member 11 and an upper horizontal member second end 172 extending from and proximate the second vertical support member 12.

A lower horizontal member 18 is disposed below, spaced apart from and parallel to the upper horizontal member 17 and extends between and substantially perpendicularly to the first vertical support member 11 and the second vertical support member 12. This lower horizontal member 18 has a lower horizontal member first end 181 extending from and proximate the first vertical support member 11 and a lower horizontal member second end 182 extending from and proximate the second vertical support member 12. A balancing strut 19 may be disposed above, spaced apart from and parallel to the upper horizontal member 17 and extends between and substantially perpendicularly to the first vertical support member 11 and the second vertical support member 12.

The length of upper horizontal member 17, lower horizontal member 18 and balancing strut 19 is determined by the width W of the associated scaffolding bay.

As shown schematically in FIG. 2, a first support bracket 100 is disposed on the upper horizontal member first end 171, a second support bracket 200 is disposed on the upper horizontal member second end 172, a third support bracket 300 is disposed on the lower horizontal member first end 181, a fourth support bracket is disposed on the lower horizontal member second end 182 and a fifth support bracket 500 is disposed on the lower horizontal member first end 181.

Each of the first support bracket 100, second support bracket 200, third support bracket 300, fourth support bracket 400 and fifth support bracket 500 include two respective leg portions and a respective connecting portion connecting the two leg portions and defining a respective open mouth portion opposite the connecting portion and between the two leg portions. For example, the support brackets 100, 200, 300, 400, 500 may comprise U-shaped or C-shaped collars and may be formed from appropriately sized channel stock.

In particular, first support bracket 100 includes first support bracket first leg portion 110, first support bracket second leg portion 120, first support bracket connecting portion 130 and first support bracket open mouth portion 140. Likewise, second support bracket 200 includes second support bracket first leg portion 210, second support bracket second leg portion 220, second support bracket connecting portion 230 and second support bracket open mouth portion 240; third support bracket 300 includes third support bracket first leg portion 310, third support bracket second leg portion 320, third support bracket connecting portion 330 and third support bracket open mouth portion 340; fourth support bracket 400 includes fourth support bracket first leg portion 410, fourth support bracket second leg portion 420, fourth support bracket connecting portion 430 and fourth support bracket open mouth portion 440; and fifth support bracket 500 includes fifth support bracket first leg portion 510, fifth support bracket second leg portion 520, fifth support bracket connecting portion 530 and fifth support bracket open mouth portion 540 (See FIGS. 3, 4 and 6).

Each of the respective open mouth portions 140, 240, 340, 440 of the first support bracket 100, second support bracket 200, third support bracket 300 and fourth support bracket 400 face a same direction parallel to the upper horizontal member 17 and lower horizontal member 18. This lateral direction is indicated with an X in FIGS. 2, 3 and 6.

Figure 4:
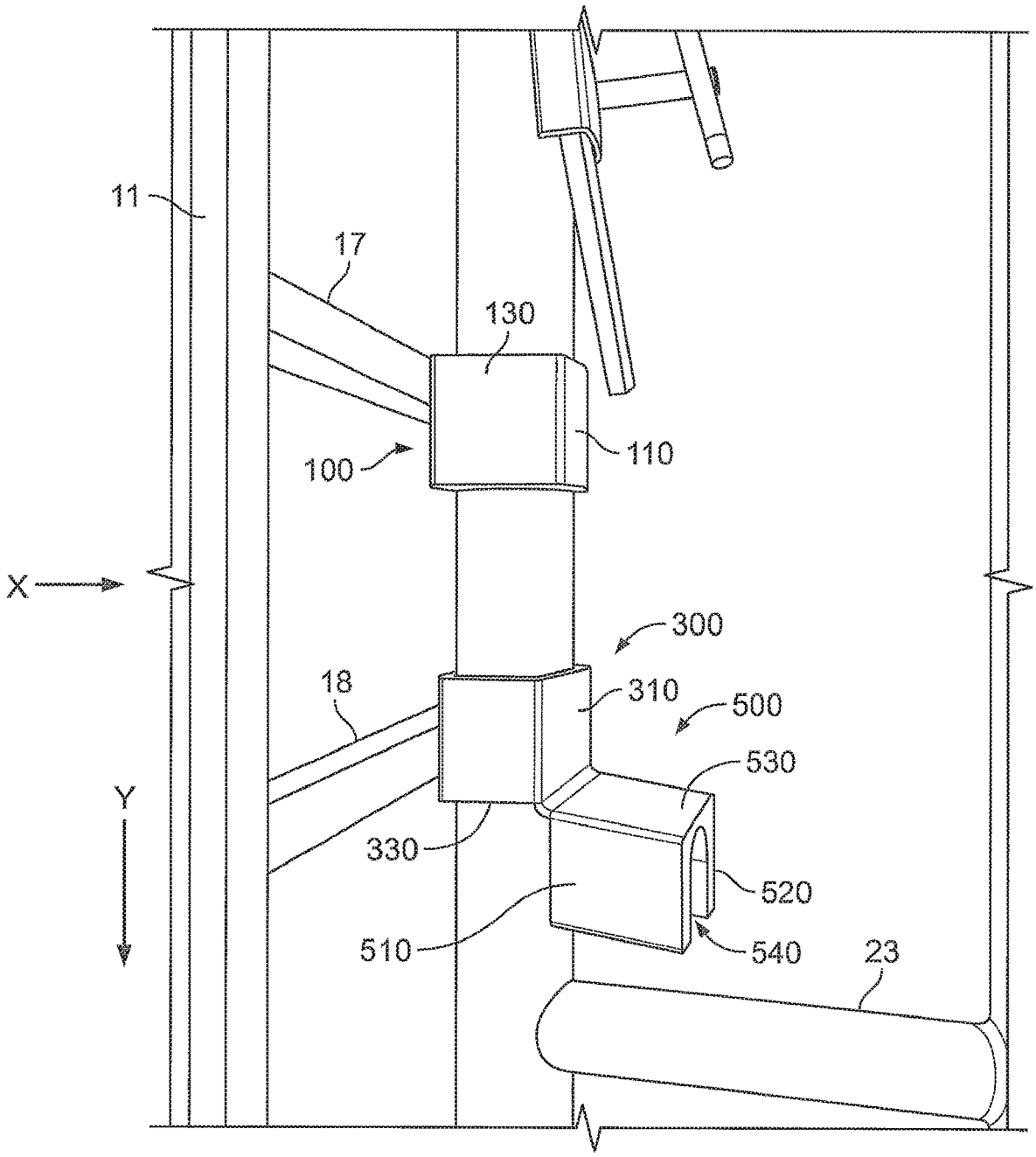
FIG. 4 shows the support brackets on a side of the modular guard rail according to an embodiment of the invention engaged with the frame of a construction scaffolding.
Figure 6:
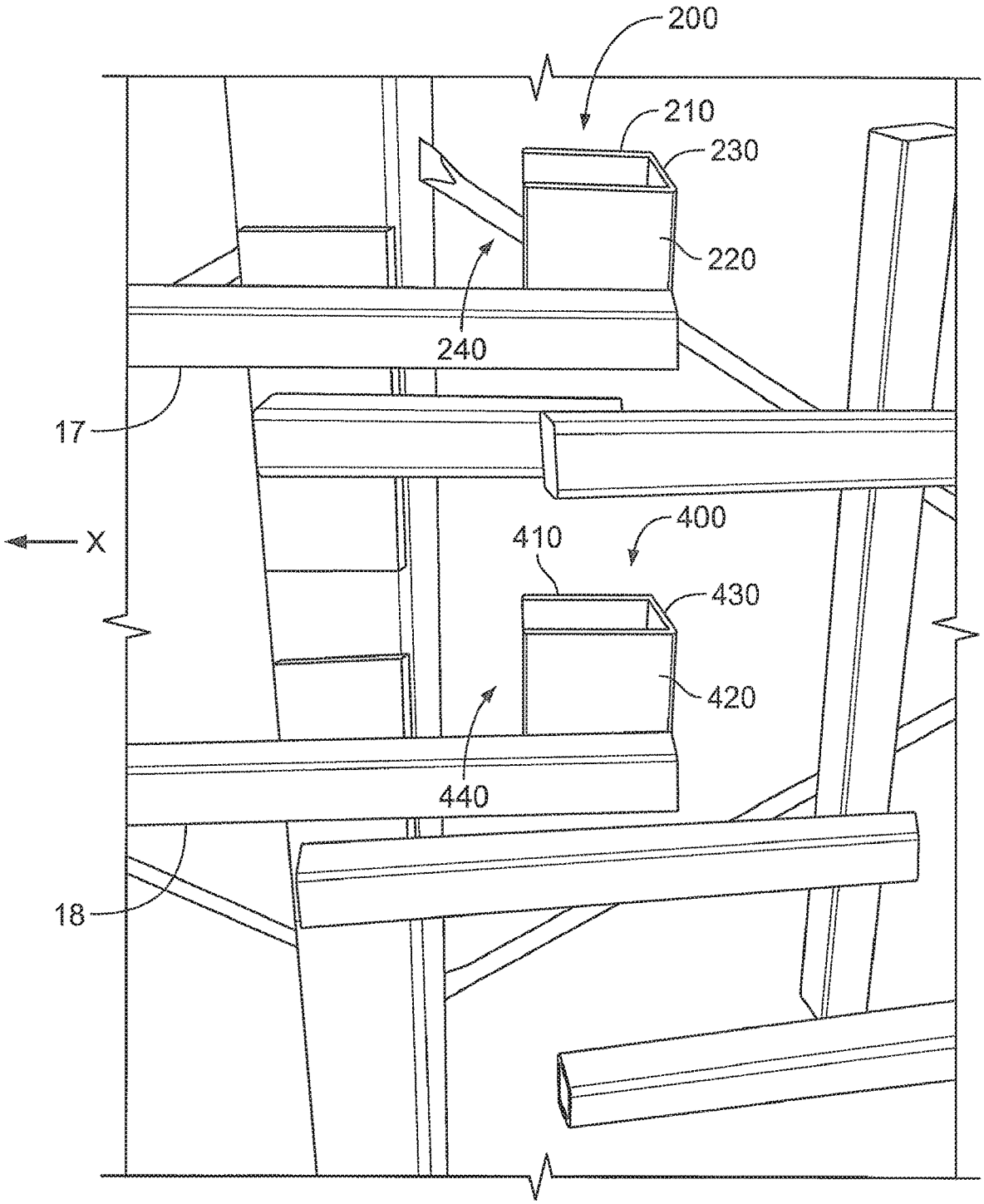
FIG. 6 shows an arrangement of support brackets at an opposite side of a modular guard rail according to an embodiment of the invention.
Figure 7:
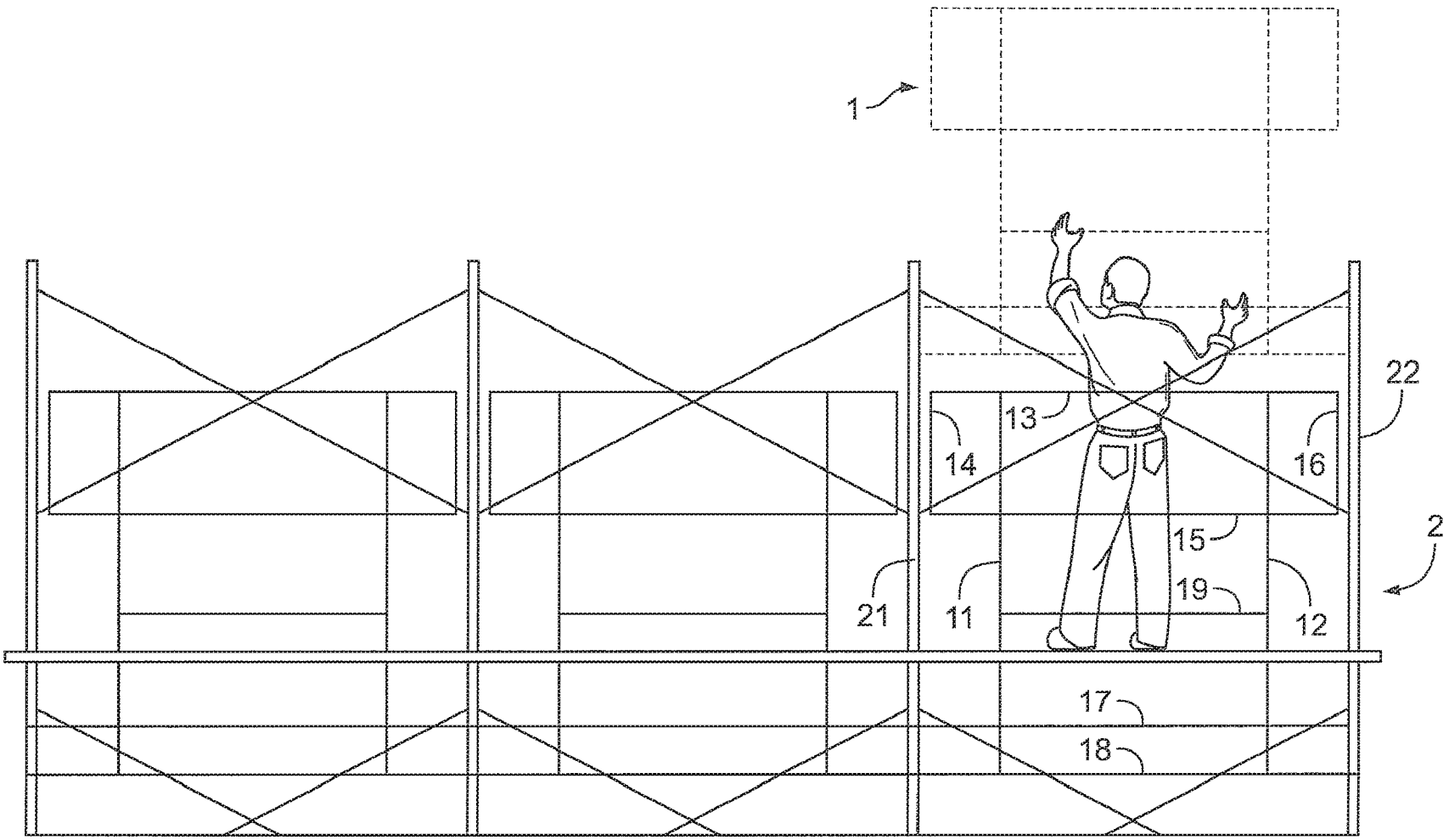
FIG. 7 shows a front view of a number of modular guard rails according to an embodiment of the invention installed on a construction scaffolding.

In this way, the first support bracket 100 and third support bracket 300 are configured to engage a first vertical post 21 of the construction scaffolding 2 (FIG. 4). The second support bracket 200 and fourth support bracket 400 are configured to engage a second vertical post 22 of the construction scaffolding 2 (FIG. 6).

Figure 3:
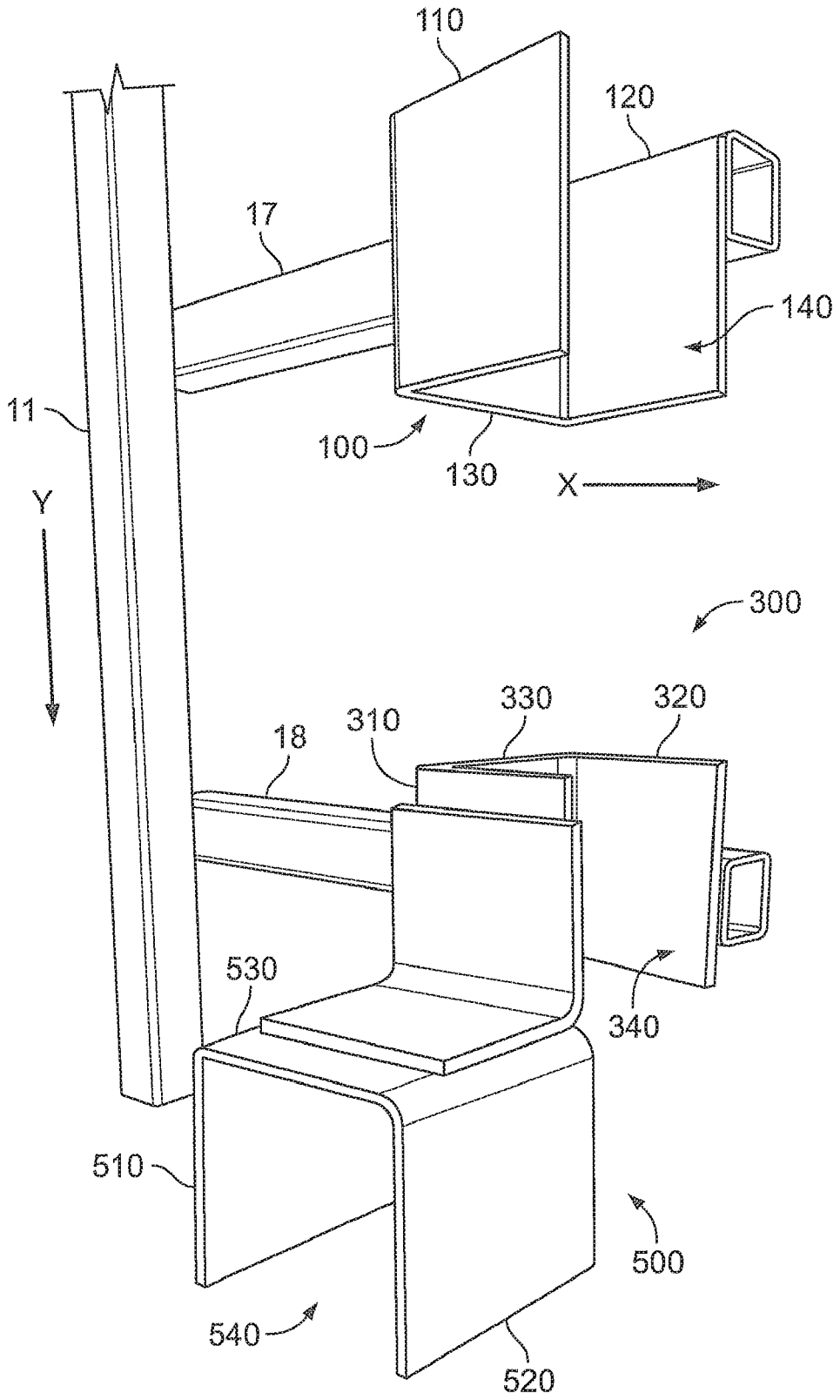
FIG. 3 shows an arrangement of support brackets at one side of a modular guard rail according to an embodiment of the invention.

As illustrated in FIGS. 3 and 4, the open mouth portion 540 of the fifth support bracket 500 faces a direction perpendicular to the upper horizontal member 17 and lower horizontal member 18. This downward direction is indicated with a Y in FIGS. 2, 3 and 4.

In this way, the fifth support bracket 500 is configured to engage a horizontal supporting strut 23 of the construction scaffolding.

Figure 5A:
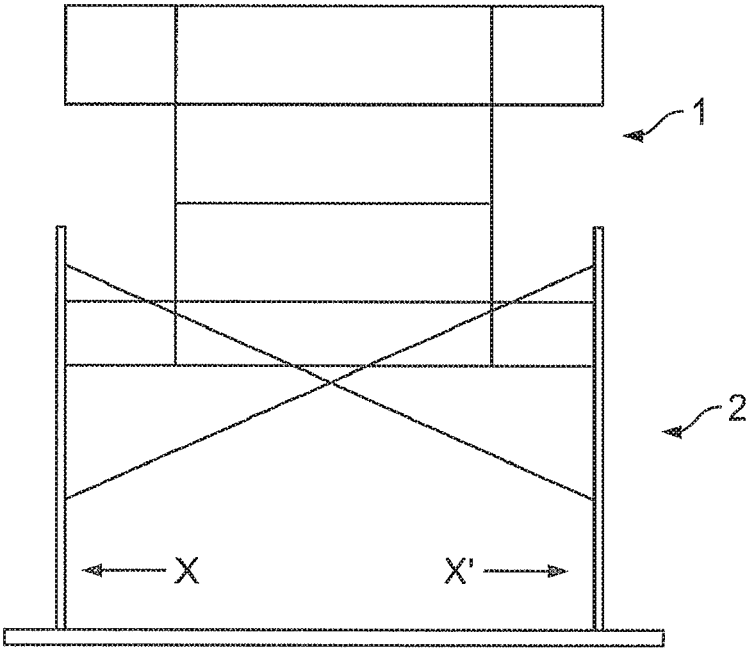
FIG. 5*a* shows a front view of a modular guard rail according to an embodiment of the invention installed on a construction scaffolding.
Figure 5B:
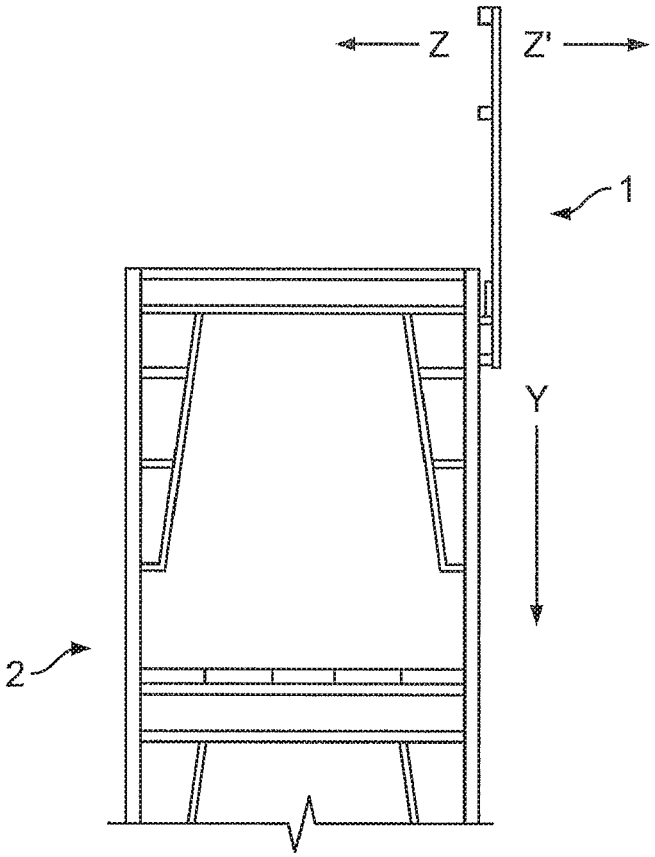
FIG. 5*b* shows a side view of a modular guard rail according to an embodiment of the invention installed on a construction scaffolding.

Thus, the configuration and arrangement of the support brackets 100, 200, 300, 400, 500 captures the main structural trunk of the scaffold frame by aligning the modular guard rail 1 combined with a lateral movement in direction X combined with an additional movement downwards in direction Y, thereby engaging the vertical posts 21, 22 and horizontal supporting strut 23 of the scaffold frame 2. This results in movement being retarded in directions X, X', Z and Z' as shown in FIGS. 5*a* and 5*b*.

As shown in FIG. 6, the second support bracket 200 and fourth support bracket 400 may be configured so that the upper horizontal support member 17 and lower horizontal support member 18 rest on a respective upper horizontal support member and a respective lower horizontal support member of a previously installed neighboring modular guard rail. In particular, the configuration of the second and fourth support brackets 200, 400 permit the associated upper horizontal member 17 and lower horizontal support member 18 to rest on the pre-installed upper and lower horizontal support members of the neighboring rail prior to and after lateral movement in direction X to capture the scaffold structure for rigidity.

A method for installing a modular guard rail 1 on a construction scaffolding 2 includes the steps of providing a modular guard rail 1 as set forth above, manually moving the modular guard rail 1 in a lateral direction X such that the first support bracket 100 and third support bracket 300 engage a first vertical post 21 of the construction scaffolding 2 and the second support bracket 200 and fourth support 400 bracket engage a second vertical post 22 of the construction scaffolding 2 and manually moving the modular guard rail 1 in a downward direction Y such that the fifth support bracket engages a horizontal supporting strut of the construction scaffolding.

Figure 8:
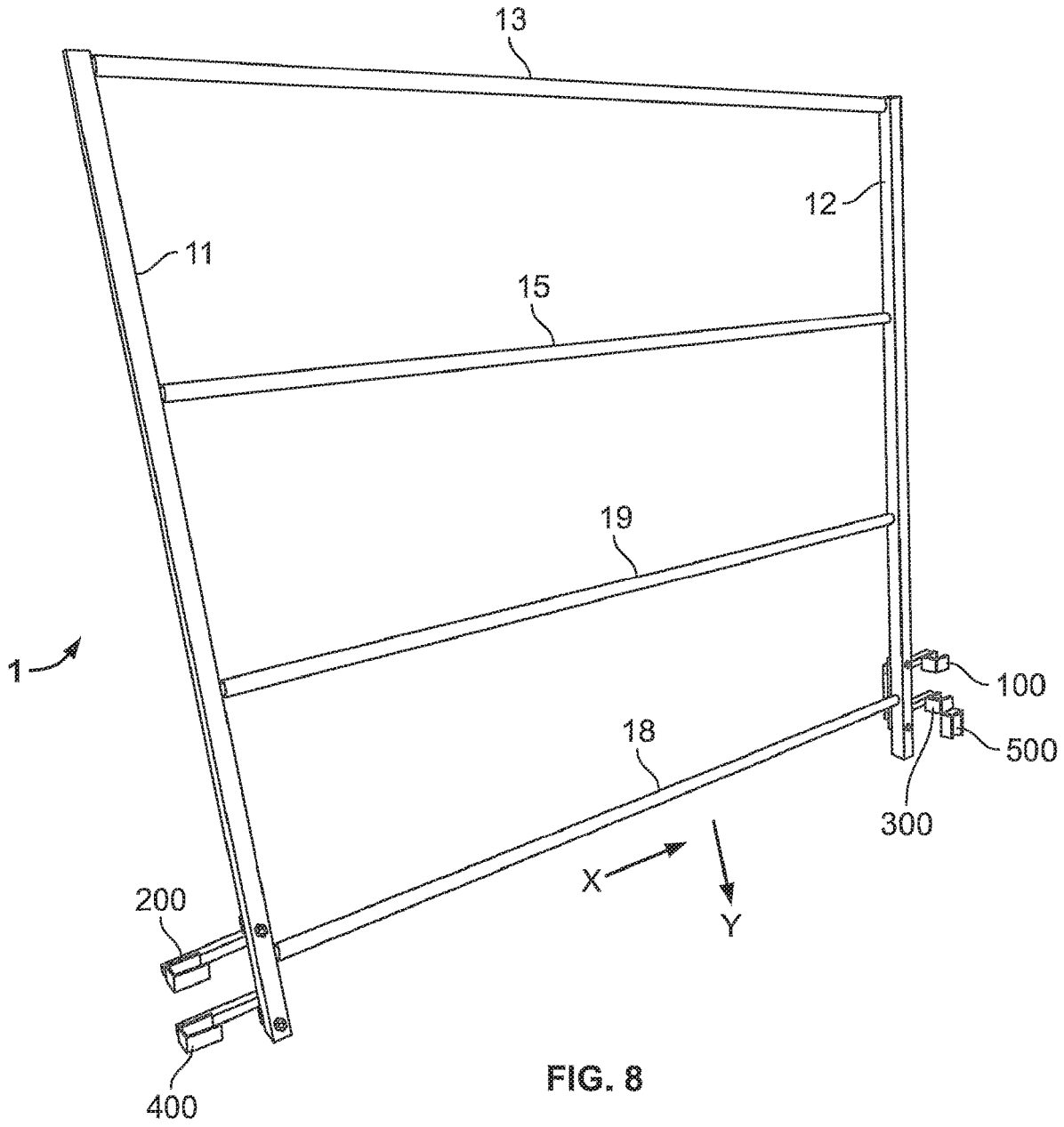
FIG. 8 shows a modular guard rail according to another embodiment of the invention.

FIG. 8 shows a modular guard rail 1 according to another embodiment of the invention. The modular guard rail 1 can be temporarily positioned on an associated construction scaffolding 2 and includes vertical members 11, 12 and horizontal members 13, 15, 18, 19 defining a guard rail frame structure 160 that engages with existing scaffold units in series to provide a guard rail system on both sides of a scaffold while in the process of assembly.

The modular guard rail 1 is secured via support brackets 100, 200, 300, 400, 500 attached to both sides of the framework bay. The support brackets do not require moving parts and are attached to the scaffold vertical posts and horizontal supporting struts by lateral and downward movement. The support brackets capture the scaffold vertical posts 21, 22 and support strut 23 in a manner such to prevent both lateral and perpendicular movement and can provide strength to a degree of 200 pounds to the guard rail.

The modular guard rail 1 is designed to be installed comfortably by a single worker who can be safely tied off to existing framework fulfilling safety requirements during this process. The modular guard rail 1 can be temporarily installed, removed and transferred for use as a fall risk eliminating guard rail incorporated into the procedure of scaffold structure assembly.

As shown, the modular guard rail 1 includes a first vertical support member 11 and a second vertical support member 12 disposed substantially parallel to and spaced apart from the first vertical support member 11. The vertical support members 11, 12 are positioned at locations defined by the width of the scaffolding bay into which they are to be installed. These vertical support members 11, 12 perpendicularly support a lattice of horizontal members 13, 15, 18, 19 creating a section of perimeter railing on top by members 13, 15 and 19.

In particular, a plurality of horizontal rails 13, 15 and 19 and first and second vertical support members 11, 12 define a guard rail frame 160. The vertical support members 11, 12 may be located approximately three inches past the plumb edge location of the next installed vertical post, such as a modular pipe frame, when the modular guard rail 1 is in an installed condition. This design will provide approximately six inches of space between each railing at the upper level to enable the installation of tie pipes to the structure that the construction scaffolding is serving without impeding the procedural movement of the transfer of a guard rail to the next location.

The length of horizontal members 13, 15, 18, 19 may be determined by the width W of the associated scaffolding bay. The horizontal members 13, 15, 18, 19 may be spaced at approximately twenty inches apart and the top two horizontal members or rails 13, 15 may serves as guard rails with the lower two horizontal members 18, 19 providing stability and balance when relocating and installing the modular guard rail 1.

As shown in FIG. 8, a first support bracket 100 is disposed at a first side of the modular guard rail 1 adjacent vertical support member 12, a second support bracket 200 is disposed at a second opposite side of modular guard rail 1 adjacent vertical support member 11, a third support bracket 300 is disposed at the first side of the modular guard rail 1 adjacent vertical support member 12, a fourth support bracket 400 is disposed at the second side of modular guard rail 1 adjacent vertical support member 11 and a fifth support bracket 500 is disposed on the first side of modular guard rail 1 adjacent vertical support member 12.

As shown, the support brackets 100, 200, 300, 400, 500 may be secured to the respective vertical support member 11, 12 by a horizontal member projecting out from the associated vertical support member 11, 12. The horizontal member may be secured to the associated vertical support member with bolts (as shown) or may be welded, or may be secured by any other suitable means.

Figure 9:
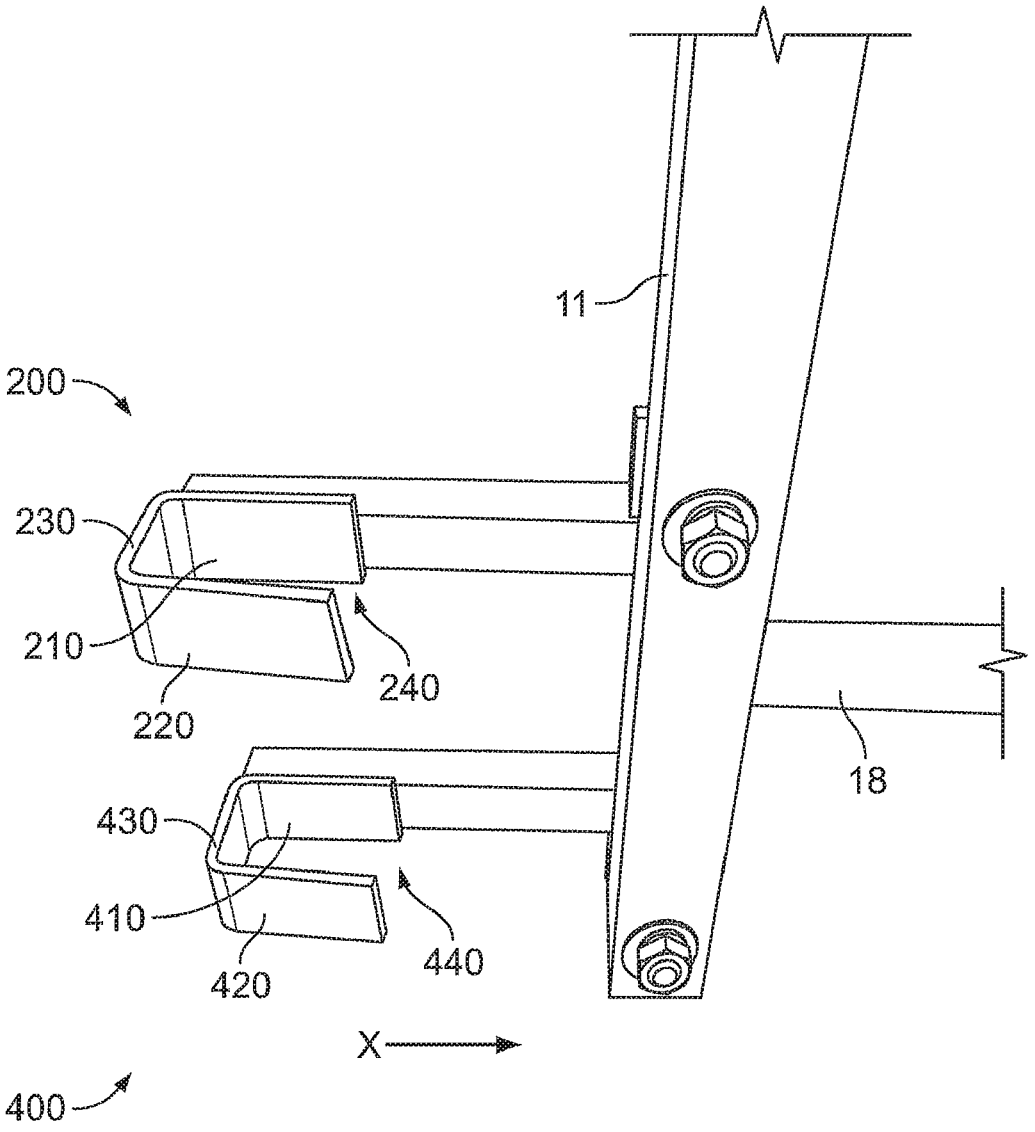
FIG. 9 shows an arrangement of support brackets at one side of a modular guard rail according to the embodiment shown in FIG. 8.
Figure 10:
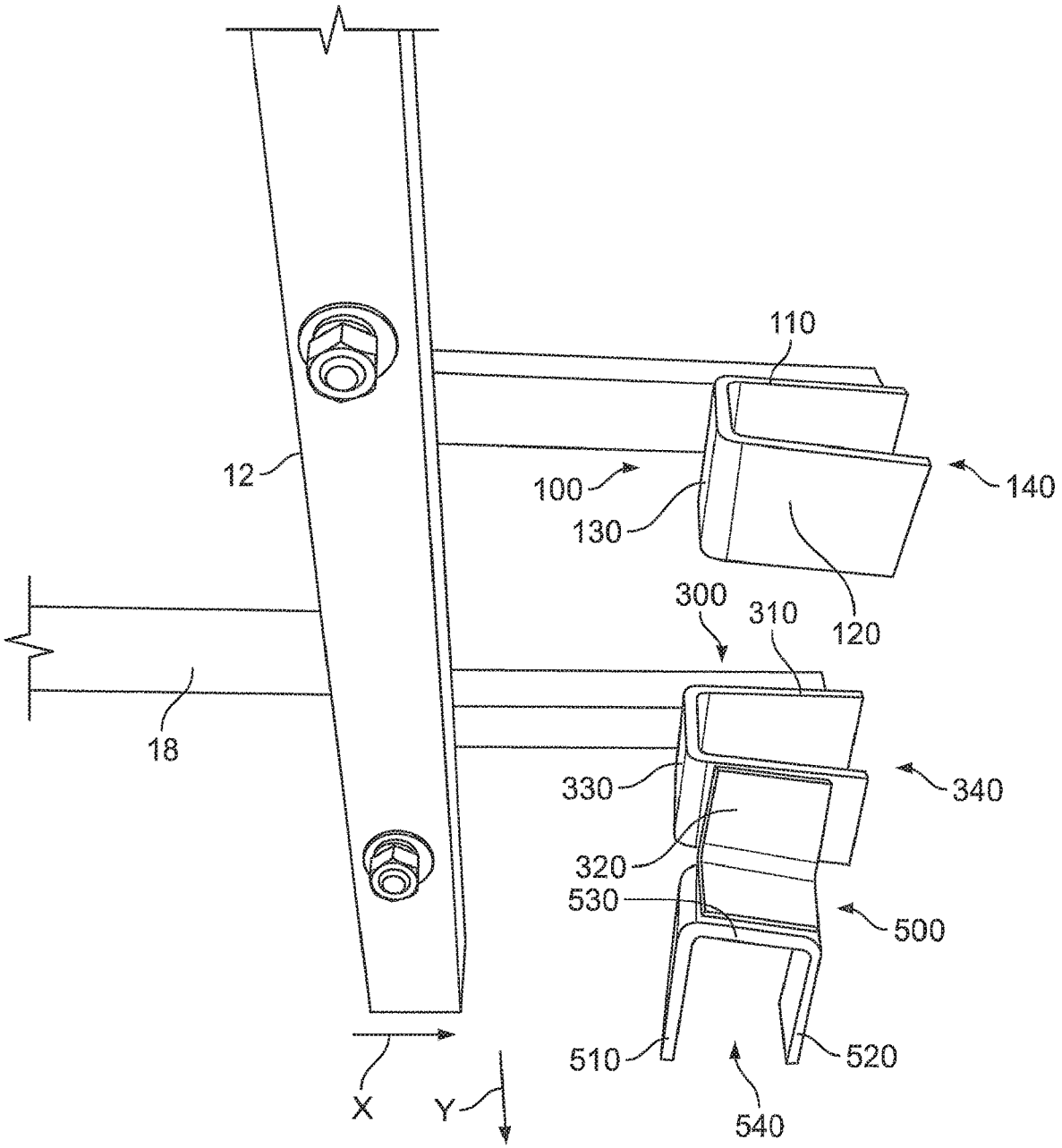
FIG. 10 shows an arrangement of support brackets at an opposite side of the modular guard rail according the embodiment shown in FIG. 8.

As shown in FIGS. 9 and 10, each of the first support bracket 100, second support bracket 200, third support bracket 300, fourth support bracket 400 and fifth support bracket 500 include two respective leg portions and a respective connecting portion connecting the two leg portions and defining a respective open mouth portion opposite the connecting portion and between the two leg portions. For example, the support brackets 100, 200, 300, 400, 500 may comprise U-shaped or C-shaped collars and may be formed from appropriately sized channel stock.

In particular, first support bracket 100 includes first support bracket first leg portion 110, first support bracket second leg portion 120, first support bracket connecting portion 130 and first support bracket open mouth portion 140. Likewise, second support bracket 200 includes second support bracket first leg portion 210, second support bracket second leg portion 220, second support bracket connecting portion 230 and second support bracket open mouth portion 240; third support bracket 300 includes third support bracket first leg portion 310, third support bracket second leg portion 320, third support bracket connecting portion 330 and third support bracket open mouth portion 340; fourth support bracket 400 includes fourth support bracket first leg portion 410, fourth support bracket second leg portion 420, fourth support bracket connecting portion 430 and fourth support bracket open mouth portion 440; and fifth support bracket 500 includes fifth support bracket first leg portion 510, fifth support bracket second leg portion 520, fifth support bracket connecting portion 530 and fifth support bracket open mouth portion 540 (See FIG. 9, 10).

Each of the respective open mouth portions 140, 240, 340, 440 of the first support bracket 100, second support bracket 200, third support bracket 300 and fourth support bracket 400 face a same direction parallel to the horizontal members 13, 15, 18, 19. This lateral direction is indicated with an X in FIGS. 8, 9 and 10.

In this way, the first support bracket 100 and third support bracket 300 are configured to engage a first vertical post 21 of the construction scaffolding 2 and second support bracket 200 and fourth support bracket 400 are configured to engage a second vertical post 22 of the construction scaffolding 2.

As illustrated in FIG. 10, the open mouth portion 540 of the fifth support bracket 500 faces a direction perpendicular to the horizontal members 13, 15, 18, 19. This downward direction is indicated with a Y in FIGS. 8 and 10.

In this way, the fifth support bracket 500 is configured to engage a horizontal supporting strut 23 of the construction scaffolding.

Thus, the configuration and arrangement of the support brackets 100, 200, 300, 400, 500 captures the main structural trunk of the scaffold frame by aligning the modular guard rail 1 combined with a lateral movement in direction X combined with an additional movement downwards in direction Y, thereby engaging the vertical posts 21, 22 and horizontal supporting strut 23 of the scaffold frame 2.

Figure 11:
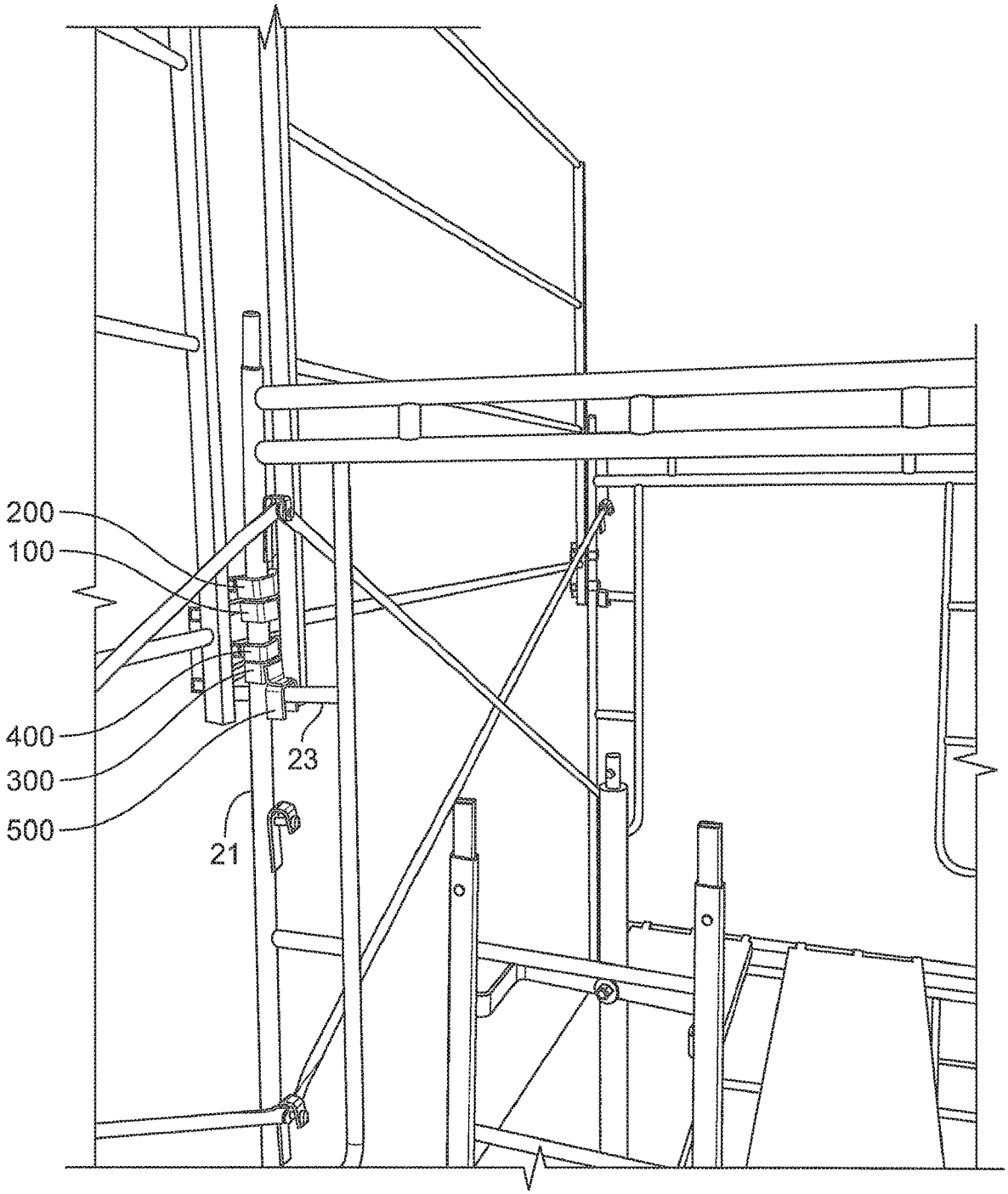
FIG. 11 shows a number of modular guard rails according to the embodiment shown in FIG. 8 installed on a construction scaffolding.
Figure 12:
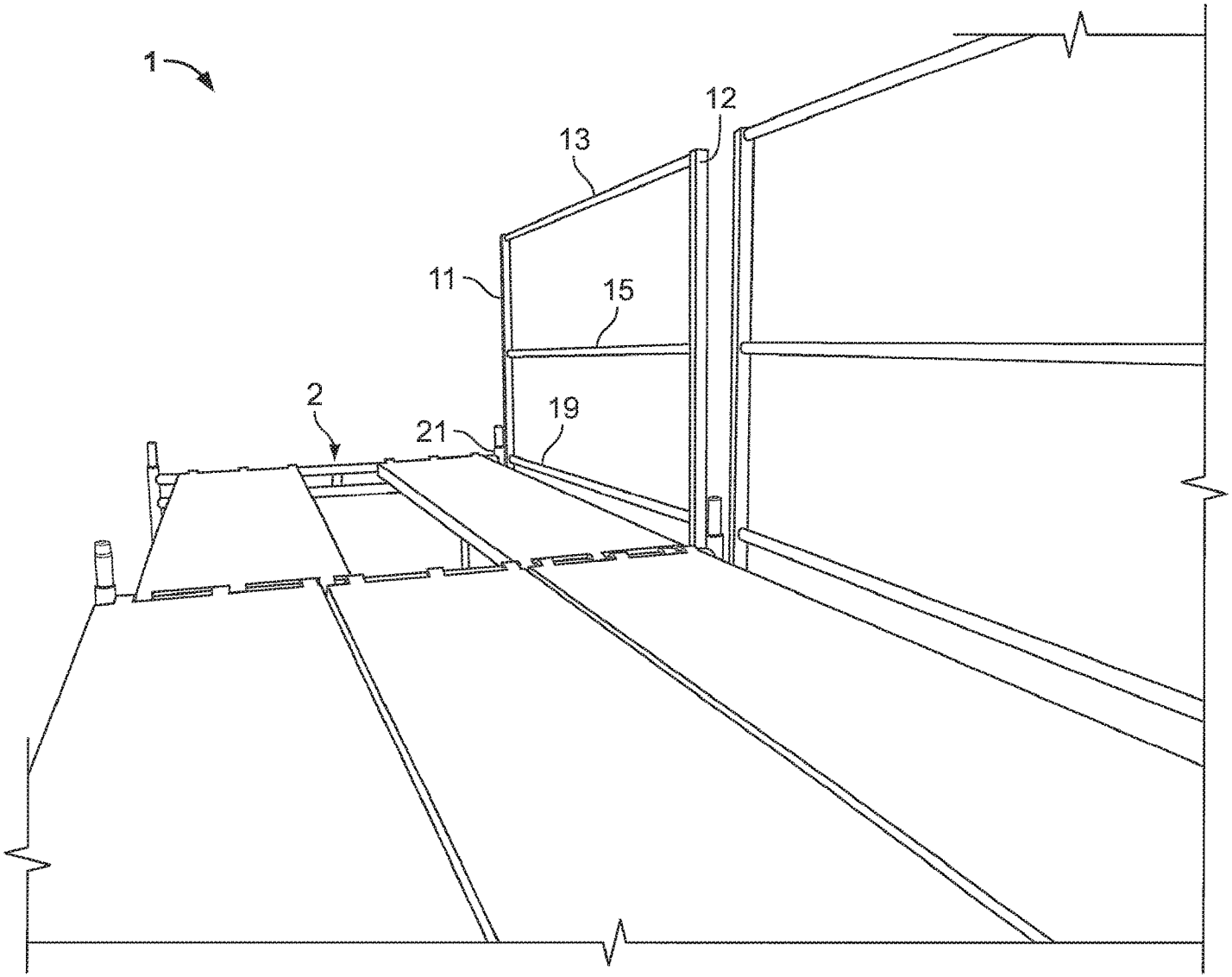
FIG. 12 shows a number of modular guard rails according to the embodiment shown in FIG. 8 installed on a construction scaffolding.

As shown in FIG. 11, the second support bracket 200 and fourth support bracket 400 may be configured so that they rest on a respective first support bracket 100 and third support bracket 300 of a previously installed neighboring modular guard rail.

A method for installing a modular guard rail 1 on a construction scaffolding 2 includes the steps of providing a modular guard rail 1 as set forth in the embodiments described above, manually moving the modular guard rail 1 in a lateral direction X such that the first support bracket 100 and third support bracket 300 engage a first vertical post 21 of the construction scaffolding 2 and the second support bracket 200 and fourth support 400 bracket engage a second vertical post 22 of the construction scaffolding 2 and manually moving the modular guard rail 1 in a downward direction Y such that the fifth support bracket engages a horizontal supporting strut of the construction scaffolding.

LIST OF REFERENCE NUMERALS

1 modular guard rail
2 construction scaffolding
11 first vertical support member
12 second vertical support member
13 horizontal rail
14 vertical end rail
15 horizontal rail
16 vertical end rail
17 upper horizontal member
18 lower horizontal member
19 balancing strut
21 vertical post
22 vertical post
23 horizontal supporting strut
100 first support bracket
110 first support bracket first leg portion
120 first support bracket second leg portion
130 first support bracket connecting portion
140 first support bracket open mouth portion
160 guard rail frame
171 upper horizontal member first end
172 upper horizontal member second end
181 lower horizontal member first end
182 lower horizontal member second end
200 second support bracket
210 second support bracket first leg portion
220 second support bracket second leg portion
230 second support bracket connecting portion
240 second support bracket open mouth portion
300 third support bracket
310 third support bracket first leg portion
320 third support bracket second leg portion
330 third support bracket connecting portion
340 third support bracket open mouth portion
400 fourth support bracket
410 fourth support bracket first leg portion
420 fourth support bracket second leg portion
430 fourth support bracket connecting portion
440 fourth support bracket open mouth portion
500 fifth support bracket
510 fifth support bracket first leg portion
520 fifth support bracket second leg portion
530 fifth support bracket connecting portion
540 fifth support bracket open mouth portion
X lateral direction
Y downward direction
W width
X' direction
Z direction
Z' direction

What is claimed:

1. A modular guard rail for construction scaffolding, the construction scaffolding having vertical posts and horizontal supporting struts, the modular guard rail comprising:

a first vertical support member;

a second vertical support member disposed substantially parallel to and spaced apart from said first vertical support member;

a plurality of horizontal rails extending between and substantially perpendicularly to said first vertical support member and said second vertical support member and along with said first vertical support member and said second vertical support member defining a guard rail frame; each of said plurality of horizontal rails having a major length extending entirely and directly between said first vertical support member and said second vertical support member;

a first support bracket disposed on a first side of the modular guard rail adjacent said first vertical support member, a second support bracket disposed on a second side of the modular guard rail opposite said first side and adjacent said second vertical support member, a third support bracket disposed on said first side of the modular guard rail adjacent said first vertical support member, and a fourth support bracket disposed on said second side of the modular guard rail adjacent said second vertical support member;

each of said first support bracket, said second support bracket, said third support bracket and said fourth support bracket comprising two respective leg portions and a respective connecting portion connecting said two leg portions and defining a respective open mouth portion opposite said connecting portion and between said two leg portions of each respective one of the first, second, third and fourth support brackets;

each of said respective open mouth portion of said first support bracket, said second support bracket, said third support bracket and said fourth support bracket facing a same direction parallel to said plurality of horizontal rails and perpendicular to said horizontal supporting struts of the construction scaffolding;

said first support bracket and said third support bracket configured to engage a first vertical post of the vertical posts of the construction scaffolding;

said second support bracket and said fourth support bracket configured to engage a second vertical post of the vertical posts of the construction scaffolding;

a fifth support bracket disposed on said first side adjacent said first vertical support member;

said fifth support bracket comprising two leg portions and a connecting portion connecting said two leg portions of said fifth support bracket and defining an open mouth portion of said fifth support bracket opposite said connecting portion of said fifth support bracket and between said two leg portions of said fifth support bracket;

said open mouth portion of said fifth support bracket, facing a direction perpendicular to said plurality of horizontal rails; and said fifth support bracket configured to engage a horizontal supporting strut of the horizontal supporting struts of the construction scaffolding.

2. The modular guard rail according to claim 1, wherein said second support bracket and said fourth support bracket are configured so that said second support bracket rests on a respective first support bracket of a previously installed neighboring modular guard rail and said fourth support bracket rests on a respective third support bracket of the previously installed neighboring modular guard rail.

3. The modular guard rail according to claim 1, wherein said first vertical support member and said second vertical support member are located approximately three inches from an edge of an adjacent vertical post of the construction scaffolding.

4. A method for installing the modular guard rail of claim 1 on the construction scaffolding, the method comprising the steps of: (a) providing the modular guard rail, (b) manually moving the modular guard rail in a lateral direction such that the first support bracket and the third support bracket engage the first vertical post of the construction scaffolding and the second support bracket and the fourth support bracket engage the second vertical post of the construction scaffolding; and (c) manually moving the modular guard rail in a downward direction such that the fifth support bracket engages a horizontal supporting strut of the horizontal supporting struts of the construction scaffolding.

* * * * *